US007565726B1

(12) United States Patent
Ko

(10) Patent No.: US 7,565,726 B1
(45) Date of Patent: Jul. 28, 2009

(54) TWO-HANDLED BLIND RIVETING TOOL WITH SPENT MANDREL COLLECTING DEVICE

(75) Inventor: Philey Ko, Taipei Hsien (TW)

(73) Assignee: Karat Industrial Corporation, Taipei Hsien (TW)

( * ) Notice: Subject to any disclaimer, the term of this patent is extended or adjusted under 35 U.S.C. 154(b) by 0 days.

(21) Appl. No.: 12/361,906

(22) Filed: Jan. 29, 2009

(30) Foreign Application Priority Data

Sep. 23, 2008 (TW) ..... 97136417 A

(51) Int. Cl.
*B21J 15/34* (2006.01)
*B23P 11/00* (2006.01)

(52) U.S. Cl. ..... 29/243.527; 29/243.521; 72/391.4

(58) Field of Classification Search ..... 29/243.521, 29/243.527; 72/391.4
See application file for complete search history.

(56) References Cited

U.S. PATENT DOCUMENTS 3,491,578 A 1/1970 Biermann
3,961,517 A 6/1976 DiMaio
5,323,521 A * 6/1994 Freund et al. ..... 29/243.527
6,021,553 A * 2/2000 Bieber et al. ..... 29/243.521

OTHER PUBLICATIONS

Data of a catalog and a web page; Gesipa Blind Riveting Systems Ltd.; http://www.gesipa.com/com/04/01/index.asp, printed on Jan. 23, 2009.

* cited by examiner

*Primary Examiner*—David B Jones
(74) *Attorney, Agent, or Firm*—Rabin & Berdo, P.C.

(57) ABSTRACT

A two-handled blind riveting tool with a spent mandrel collecting device has a rivet setting assembly and a driving handle and a spent mandrel collecting device being separately mounted on a housing of the rivet setting assembly. A stationary handle of the spent mandrel collecting device has an elongated hole, a guider of the spent mandrel collecting device is mounted between the housing and the stationary handle, and a guiding tube of the spent mandrel collecting device is mounted in the housing. Snapped mandrels slide along the guiding tube and the guider and then drop into the stationary handle. Therefore, the snapped mandrels do not hurt an operator for improved safety and are recycled to keep working areas clean.

14 Claims, 6 Drawing Sheets

TWO-HANDLED BLIND RIVETING TOOL WITH SPENT MANDREL COLLECTING DEVICE

BACKGROUND OF THE INVENTION

1. Field of the Invention

The present invention relates to a blind riveting tool, especially to a two-handled blind riveting tool having a spent mandrel collecting device.

2. Description of the Prior Arts

A blind rivet is a kind of fastener, is mounted through at least two adjacent working pieces from only one side to securely hold the working pieces together and comprises a rivet body and a mandrel. A hole is drilled through the working pieces, then the blind rivet is mounted in the hole through both working pieces. The mandrel is pulled through the rivet body by a blind riveting tool and snaps at a predetermined force, causing the rivet body to deform and hold two working pieces.

Since the mandrel and the rivet body are metal or reinforced plastics, the predetermined force is generally high, so a snapped mandrel may shoot at high speed. Therefore, a blind riveting tool with safety design has a spent mandrel collecting device to prevent the snapped mandrels from hurting operators, especially eyes of the operators, to allow the snapped mandrels to be recycled and to keep working areas clean.

With reference to FIG. 5, a conventional two-handled blind riveting tool such as a Rivet Setting Tool (U.S. Pat. No. 3,961,517) comprises a housing (61), a stationary handle (62) and a driving handle (63).

The housing (61) has a front end, a rear end, a driving device, a sleeve (611) and a snapping device. The driving device is mounted in the housing (61). The sleeve (611) is mounted on the front end of the housing (61) and communicates with the housing (61). The snapping device is mounted in the sleeve (611), is connected to the driving device and selectively clamps a mandrel of a blind rivet.

The stationary handle (62) is curved and is securely mounted on the rear end of the housing (61).

The driving handle (63) is curved, is pivotally mounted on the rear end of the housing (61), is connected to the driving device of the housing (61) and drives the snapping device through the driving device to snap the mandrel. Then the snapped mandrel drops out of the housing (61) from the rear end of the housing (61).

To fasten the blind rivet effectively and firmly in the working pieces, it is necessary to insert the rivet body into the working pieces perpendicularly, to pull and snap mandrel by the snapping device of the blind riveting tool perpendicularly against the working pieces. The curved stationary handle (62) and the curved driving handle (63) of the conventional blind riveting tool allow the operator conveniently to locate rivet body into the working pieces perpendicularly, and easily to pivot the driving handle (63) to pull and snap mandrel by the snapping derive perpendicularly against the working pieces to fasten blind rivet in the working pieces effectively and firmly. However, a gapping place between the housing (61), stationary handle (62) and driving handle (63) is too small to allow a spent mandrel collecting device to be mounted on the rear end of the housing (61).

With reference to FIG. 6, another conventional two-handled blind riveting tool comprising a housing (71), a stationary handle (72), a driving handle (73), two grips (74) and a spent mandrel collecting device (75).

The housing (71) has a rear end. The stationary handle (72) is straight and is securely mounted on the rear end of the housing (71). The driving handle (73) is straight and is pivotally mounted on the rear end of the housing (71).

The grips (74) are respectively mounted around the stationary handle (72) and the driving handle (73). Each grip (74) has a block (741). The block (741) is formed on the grip (74) and selectively abuts the block (741) of the other grip (74). Therefore, a gapping place between the rear end of the housing (71), stationary handle (72) and driving handle (73) is formed.

The spent mandrel collecting device (75) is mounted in the gapping place and has a connector (751), a collecting box (753) and a guiding tube (752). The connector (751) is mounted on the rear end of the housing (71). The collecting box (753) is detachably mounted on the stationary handle (72) and is mounted around the connector (751). The guiding tube (752) is mounted through the connector (751) and communicates with the housing (71) and the collecting box (753).

Therefore, when the conventional blind riveting tool snaps a mandrel (51C), the snapped mandrel (51C) slides into and along the guiding tube (752) and is stored in the collecting box (753). Then, the collecting box (753) is detached and the snapped mandrels (51C) in the collecting box (753) are disposed of. The driving handle (73) does not crush the collecting box (753) since the blocks (741) of the grips (74) abut each other.

However, the conventional blind riveting tool as described still has the following disadvantages. The straight stationary handle (72) and the straight driving handle (73) prevent the operator conveniently locating the conventional blind riveting tool perpendicular to the working pieces. Moreover, when the driving handle (73) pivots toward the stationary handle (72), should the blocks (741) of the grips (74) be misaligned, the handles (72, 73) may crush the collecting box (753). Furthermore, as the collecting box (753) is frequently detached from the stationary handle (72) to dispose of the snapped mandrels (51C), the collecting box (753) may be damaged or lost.

To overcome the shortcomings, the present invention provides a two-handled blind riveting tool with a spent mandrel collecting device to mitigate or obviate the aforementioned problems.

SUMMARY OF THE INVENTION

The main objective of the present invention is to provide a two-handled blind riveting tool with a spent mandrel collecting device. The two-handled blind riveting tool has a rivet setting assembly and a driving handle and a spent mandrel collecting device being separately mounted on a housing of the rivet setting assembly. A stationary handle of the spent mandrel collecting device has an elongated hole, a guider of the spent mandrel collecting device is mounted between the housing and the stationary handle and a guiding tube of the spent mandrel collecting device is mounted in the housing.

Snapped mandrels slide along the guiding tube and the guider and then drop into the stationary handle. Therefore, the snapped mandrels do not hurt an operator for improved safety and are recycled to keep working areas clean.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
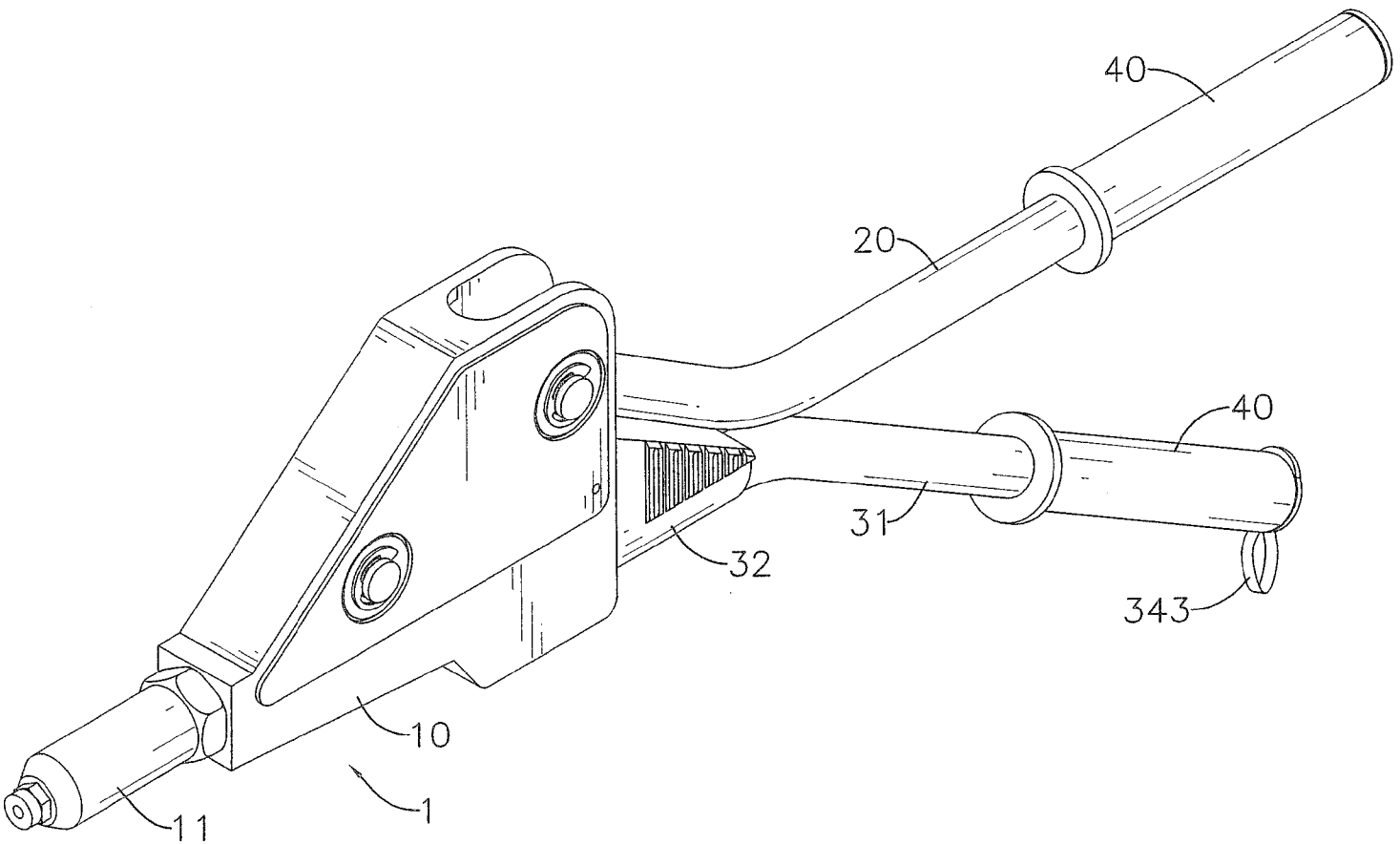
FIG. 1 is a perspective view of a two-handled blind riveting tool with a spent mandrel collecting device in accordance with the present invention.
Figure 2:
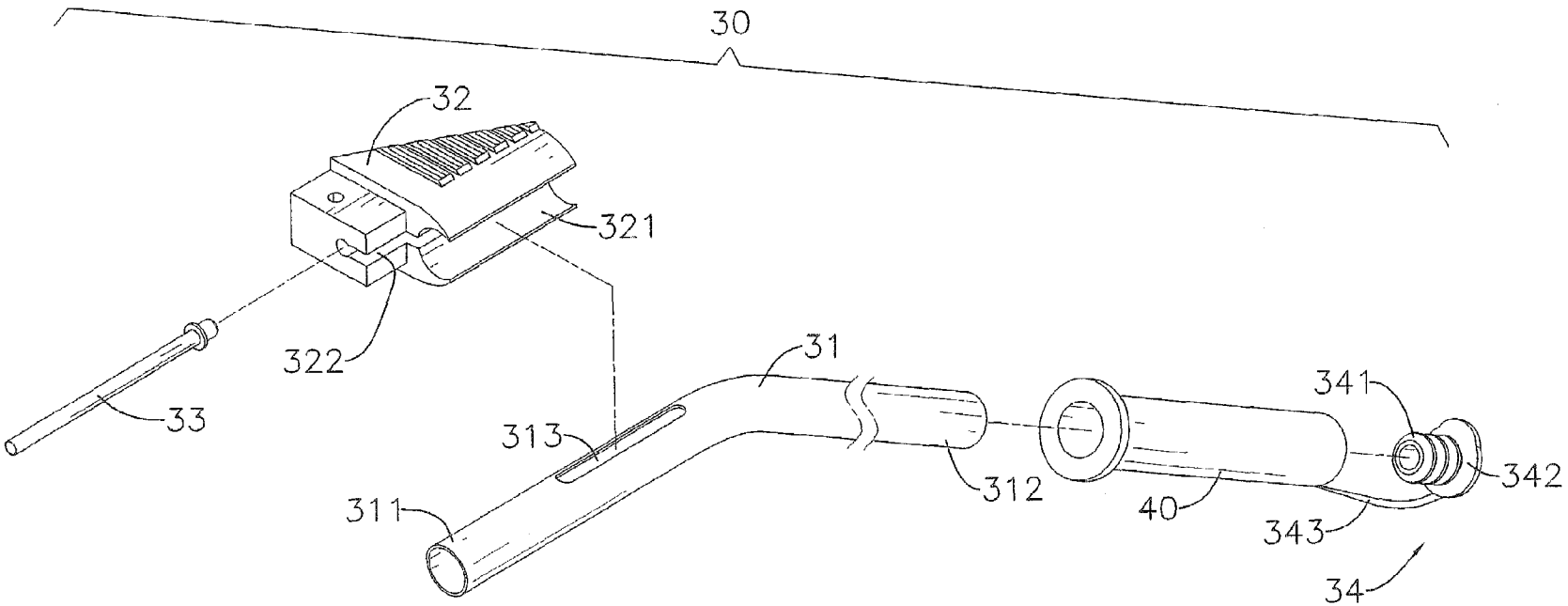
FIG. 2 is an enlarged exploded perspective view of the two-handled blind riveting tool in FIG. 1.
Figure 3:
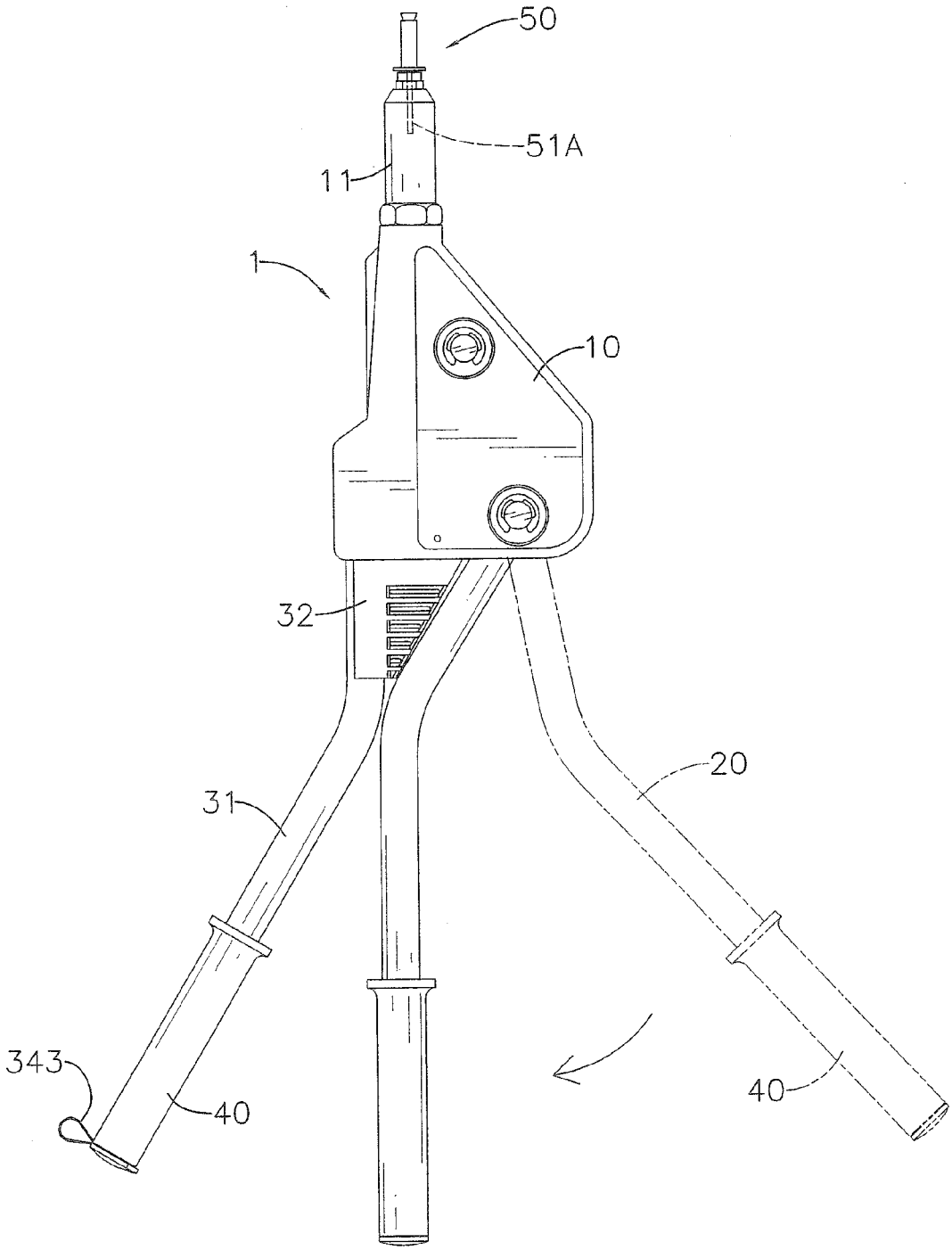
FIG. 3 is an operational side view of the two-handled blind riveting tool in FIG. 1.

With reference to FIGS. 1 to 3, a two-handled blind riveting tool with a spent mandrel collecting device in accordance with the present invention comprises a rivet setting assembly (1), a driving handle (20) and a spent mandrel collecting device (30) and may comprise two grips (40).

Figure 4:
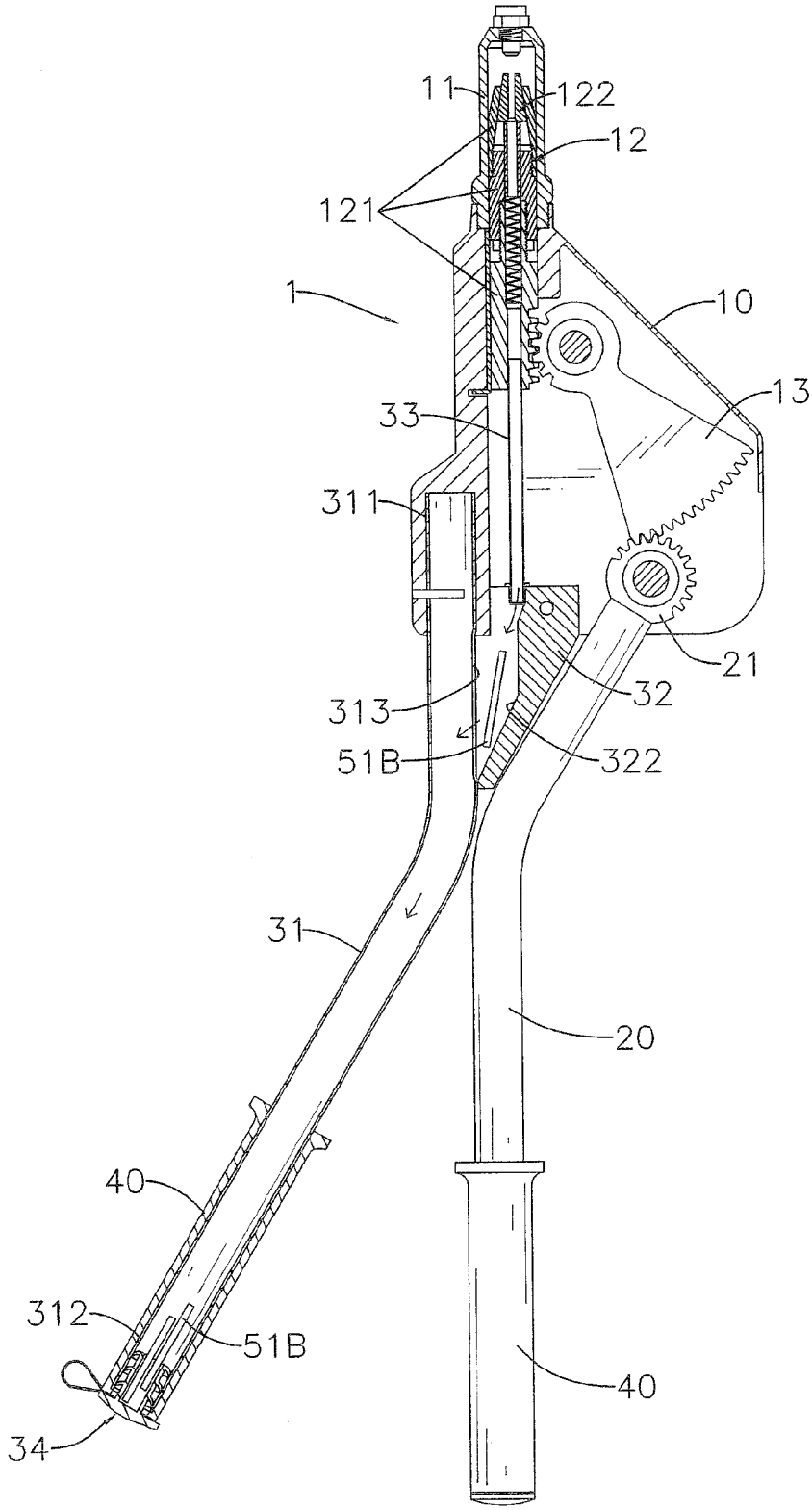
FIG. 4 is an operational side view in partial section of the two-handled blind riveting tool in FIG. 1.
Figure 5:
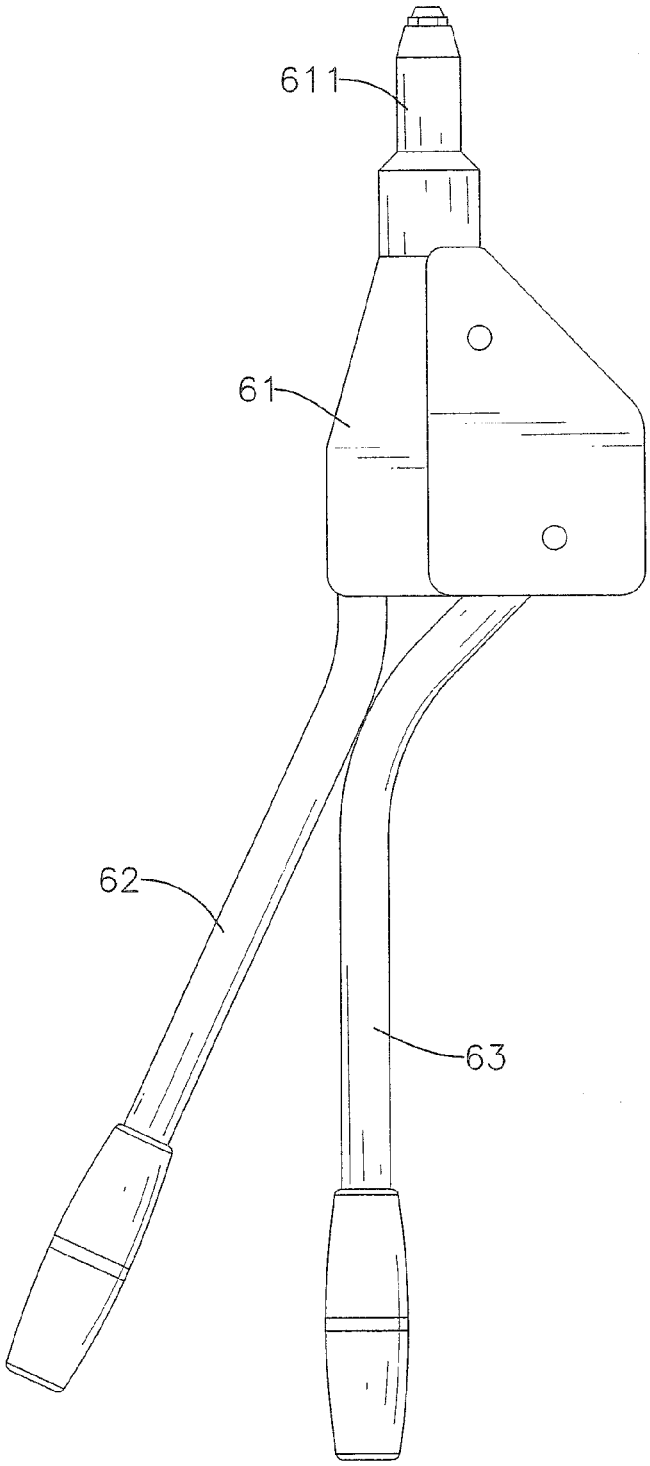
FIG. 5 PRIOR ART
FIG. 5 is a side view of a conventional blind riveting tool in accordance with the prior art.
Figure 6:
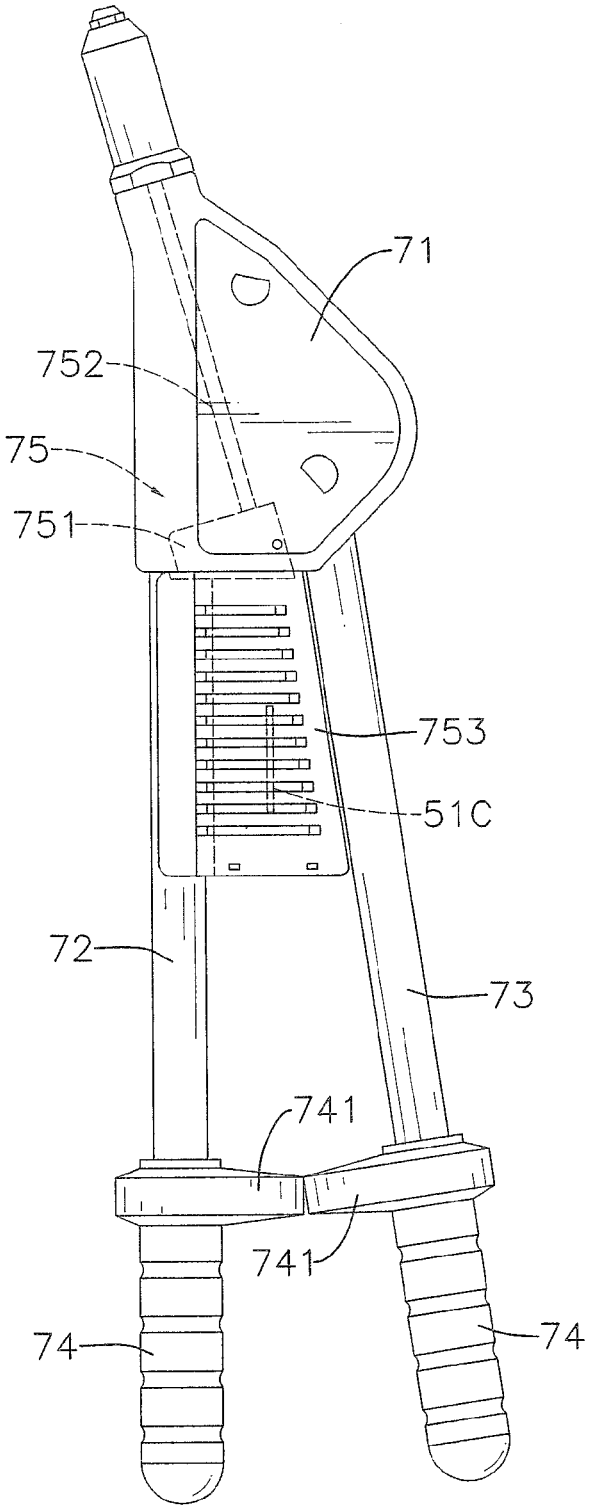
FIG. 6 PRIOR ART
FIG. 6 is a side view of another conventional blind riveting tool in accordance with the prior art, showing a connector and a guiding tube in phantom lines.

With further reference to FIG. 4, the rivet setting assembly (1) has a housing (10), a sleeve (11), a snapping device (12) and a driving device (13).

The housing (10) has a front end and a rear end.

The sleeve (11) is mounted on the front end of the housing (10) and allows a mandrel (51A) of a blind rivet (50) to be mounted through the sleeve (11).

The snapping device (12) is mounted between the sleeve (11) and the housing (10), selectively clamps the mandrel (51A) of the blind rivet (50) and may have a slider (121) and multiple jaws (122). The slider (121) is glidingly mounted between the sleeve (11) and the housing (10) and has a clamping end, a driving end, a passageway and an outer surface. The passageway is axially formed through the slider (121). The outer surface of the slider (121) is teethed adjacent to the driving end of the slider (121). The jaws (122) are arranged in the clamping end of the slider (121) and selectively clamp or release the mandrel (51A) of the blind rivet (50). Each jaw (122) is tapered.

The driving device (13) is pivotally mounted in the housing (10), is connected to the snapping device (12), may be connected to the slider (121) of the snapping device (12) to drive the slider (121) to slide axially along the sleeve (11) and may have a driving end and a driven end. The driving end of the driving device (13) is teethed and engages the teethed outer surface of the slider (121) of the snapping device (12). The driven end of the driving device (13) is teethed.

The driving handle (20) may be curved and has an inner end (21). The inner end (21) of the driving handle (20) is pivotally mounted in the rear end of the housing (10), is connected to the driving device (13) of the rivet setting assembly (1), may be teethed and may engage the driven end of the driving device (13) of the rivet setting assembly (1). Therefore, when the driving handle (20) is pivoted, the slider (121) of the snapping device (112) is driven through the driving device (13) of the rivet setting assembly (1).

The spent mandrel collecting device (30) is mounted on the rear end of the housing (10) and has a stationary handle (31), a guider (32), a guiding tube (33) and a cap (34).

The stationary handle (31) is tubular, may be curved and has a sidewall, a fastening end (311), an open end (312) and an elongated hole (313). The fastening end (311) of the stationary handle (31) is securely mounted into the rear end of the housing (10). The elongated hole (313) is axially formed through the sidewall of the stationary handle (31).

The guider (32) is wedge-shaped, is mounted in the rear end of the housing (10), corresponds to the elongated hole (313) of the stationary handle (31) and has a positioning recess (321) and a guiding channel (322). The positioning recess (321) is formed in the guider (32), corresponds to and is mounted around the stationary handle (31). The guiding channel (322) is formed through the guider (32), communicates with the housing (10) and the stationary handle (31), may communicate with the positioning recess (321) of the guider (32) and has an inlet end and an outlet opening. The inlet end of the guiding channel (322) communicates with the housing (10). The outlet opening of the guiding channel (322) corresponds to the elongated hole (313) of the stationary handle (31) and communicates with the stationary handle (31).

The guiding tube (33) is mounted in the housing (10) and has two ends. The ends of the guiding tube (33) are respectively connected to the inlet end of the guiding channel (322) of the guider (32) and to the snapping device (12), communicate with the guiding channel (322) of the guider (32) and the snapping device (12). The end of the guiding tube (33) connected to the snapping device (12) may be connected to the driving end of the slider (121) of the snapping device (12) and may communicate with the passageway of the slider (121). Therefore, a snapped mandrel (51B) being snapped by the snapping device (12) slides along the passageway of the slider (121), the guiding tube (33) and the guiding channel (322) of the guider (32) and through the elongated hole (313) of the stationary handle (31) and then drops into the stationary handle (31).

The cap (34) is detachably mounted on the open end (312) of the stationary handle (31) to prevent the snapped mandrel (51B) being stored in the stationary handle (31) from dropping out of the stationary handle (31) and may have a blind flange (342), a plug (341) and a connecting strap (343). The blind flange (342) is mounted on the open end (312) of the stationary handle (31) and has an inner surface. The plug (341) is formed on and protrudes from the inner surface of the blind flange (342) and selectively plugs the open end (312) of the stationary handle (31). The connecting strap (343) is formed on the blind flange (342).

The grips (40) are respectively mounted around the driving handle (20) and the stationary handle (31) to allow an operator to stably hold the handles (20, 31). The grip (40) mounted around the stationary handle (31) is connected to the connecting strap (343) of the cap (34) to prevent the cap (34) from being lost.

When the driving handle (20) pivots away from the stationary handle (31), the driving handle (20) and the driving device (13) of the rivet setting assembly (1) drive the slider (121) of the snapping device (12) toward the sleeve (11). The jaws (122) of the snapping device (12) are released and the mandrel (51A) of the blind rivet (50) is mounted through the passageway of the slider (121) and between the jaws (122).

Afterwards, When the driving handle (20) pivots toward the stationary handle (31), the driving handle (20) and the driving device (13) of the rivet setting assembly (1) drive the slider (121) of the snapping device (12) toward the housing (10). The slider (121) presses the jaws (122) of the snapping device (12) and the jaws (122) stably clamp the mandrel (51A) of the blind rivet (50) and then snap the mandrel (51A).

The two-handled blind riveting tool with the spent mandrel collecting device as described has the following advantages. The snapped mandrel (51B) is not stored in the guider (32) but is stored in the stationary handle (31). The guider (32) allows the snapped mandrel (51B) to slide into the stationary handle (31). Therefore, the two-handled blind riveting tool recycles the snapped mandrel (51B) to prevent the snapped mandrel (51B) from hurting the operator, especially eyes of the operator and keeps working areas clean. Moreover, the guider (32) is small and the driving handle (20) and the stationary handle (31) are curved to allow the operator conveniently to locate the blind riveting tool perpendicular to working pieces and easily to pivot the driving handle (20). The driving handle (20) and the stationary handle (31) do not crush the guider (32).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A two-handled blind riveting tool comprising a rivet setting assembly having a housing having a front end; and a rear end;

a sleeve being mounted on the front end of the housing;

a snapping device being mounted between the sleeve and the housing; and a driving device being pivotally mounted in the housing and being connected to the snapping device;

a driving handle having an inner end being pivotally mounted in the rear end of the housing and being connected to the driving device of the rivet setting assembly; and a spent mandrel collecting device being mounted on the rear end of the housing and having a stationary handle being tubular and having a sidewall;

a fastening end being securely mounted into the rear end of the housing;

an elongated hole being axially formed through the sidewall of the stationary handle;

a guider being mounted in the rear end of the housing, corresponding to the elongated hole of the stationary handle and having a guiding channel being formed through the guider, communicating with the housing and the stationary handle and having an inlet end communicating with the housing; and an outlet opening corresponding to the elongated hole of the stationary handle and communicating with the stationary handle; and a guiding tube being mounted in the housing and having two ends being respectively connected to the inlet end of the guiding channel of the guider and to the snapping device and communicating with the guiding channel of the guider and the snapping device.

2. The two-handled blind riveting tool as claimed in claim 1, wherein the guider of the spent mandrel collecting device further has a positioning recess being formed in the guider, corresponding to and being mounted around the stationary handle; and the guiding channel of the guider communicates with the positioning recess of the guider.

3. The two-handled blind riveting tool as claimed in claim 1, wherein the stationary handle of the spent mandrel collecting device further has an open end; and a cap being detachably mounted on the open end of the stationary handle.

4. The two-handled blind riveting tool as claimed in claim 3, wherein the cap of the spent mandrel collecting device further has a blind flange being mounted on the open end of the stationary handle and having an inner surface; and a plug being formed on and protruding from the inner surface of the blind flange and selectively plugging the open end of the stationary handle.

5. The two-handled blind riveting tool as claimed in claim 1, wherein the driving handle and the stationary handle are curved.

6. The two-handled blind riveting tool as claimed in claim 2, wherein the driving handle and the stationary handle are curved.

7. The two-handled blind riveting tool as claimed in claim 3, wherein the driving handle and the stationary handle are curved.

8. The two-handled blind riveting tool as claimed in claim 4, wherein the driving handle and the stationary handle are curved.

9. The two-handled blind riveting tool as claimed in claim 5 further comprising two grips being respectively mounted around the driving handle and the stationary handle.

10. The two-handled blind riveting tool as claimed in claim 6 further comprising two grips being respectively mounted around the driving handle and the stationary handle.

11. The two-handled blind riveting tool as claimed in claim 7 further comprising two grips being respectively mounted around the driving handle and the stationary handle.

12. The two-handled blind riveting tool as claimed in claim 8 further comprising two grips being respectively mounted around the driving handle and the stationary handle.

13. The two-handled blind riveting tool as claimed in claim 5, wherein the cap of the spent mandrel collecting device further has a connecting strap being formed on the blind flange of the cap and being connected to the grip mounted around the stationary handle.

14. The two-handled blind riveting tool as claimed in claim 1, wherein the snapping device of the rivet setting assembly further has a slider being glidingly mounted between the sleeve and the housing and having a clamping end;

a driving end;

a passageway being axially formed through the slider; and an outer surface being teethed adjacent to the driving end of the slider; and multiple jaws being arranged in the clamping end of the slider, and each jaw being tapered;

the inner end of the driving handle is teethed;

the driving device of the rivet setting assembly further has a driving end being teethed and engaging the teethed outer surface of the slider of the snapping device; and a driven end being teethed and engaging the teethed inner end of the driving handle; and the end of the guiding tube connected to the snapping device is connected to the driving end of the slider of the snapping device and communicates with the passageway of the slider.

* * * * *